US007140745B2

(12) United States Patent
Yuen

(10) Patent No.: US 7,140,745 B2
(45) Date of Patent: Nov. 28, 2006

(54) HAND-HELD CHARGEABLE OPTOELECTRONIC ILLUMINATING LAMP

(76) Inventor: Se Kit Yuen, 6/F., Yau Lee Center, 45 Hoi Yuen Road, Kwun Tong, Kowloon, Hong Kong (CN)

( * ) Notice: Subject to any disclaimer, the term of this patent is extended or adjusted under 35 U.S.C. 154(b) by 0 days.

(21) Appl. No.: 11/168,708

(22) Filed: Jun. 28, 2005

(65) Prior Publication Data

US 2006/0221601 A1 Oct. 5, 2006

(30) Foreign Application Priority Data

Apr. 4, 2005 (CN) ..... 2005 2 0120902

(51) Int. Cl.
*F21L 14/02* (2006.01)

(52) U.S. Cl. ..... 362/183; 362/202

(58) Field of Classification Search ..... 362/183, 362/190, 202, 184
See application file for complete search history.

(56) References Cited

U.S. PATENT DOCUMENTS 4,514,790 A * 4/1985 Will ..... 362/183
D348,942 S * 7/1994 Yuen ..... D26/42
5,847,540 A * 12/1998 Burns et al. ..... 320/107
6,805,461 B1 * 10/2004 Witte ..... 362/169
2006/0176690 A1 * 8/2006 Yuen ..... 362/200

* cited by examiner

*Primary Examiner*—Laura K. Tso
(74) *Attorney, Agent, or Firm*—Alix, Yale & Ristas, LLP

(57) ABSTRACT

The present utility model discloses a hand-held chargeable optoelectronic illuminating lamp which comprises: a hollow lamp body; a battery frame, which is accommodated within the hollow lamp body and a plurality of rechargeable batteries mounted thereon; a light emitting unit, which is provided at front ends of the lamp body and the battery frame, for emitting visible light; a power supply plug, which is movably provided at a rear end of the lamp body, for fitting with a outside socket of commercial power; and a handle, which is pivotally connected to the lamp body, has an accommodating space therein, said handle may locate on a first position or a second position relative to the lamp body, wherein: the handle is parallel to the lamp body and the power supply plug is contained in the accommodating space when the handle locates on the first position; the handle is perpendicular to the lamp body and the power supply plug is exposed out of the rear end of the lamp so as to implement charging operation when the handle locates on the second position.

11 Claims, 11 Drawing Sheets

HAND-HELD CHARGEABLE OPTOELECTRONIC ILLUMINATING LAMP

This application claims the benefit of Chinese Patent Application No. 200520012090.2, filed Apr. 4, 2005, the contents of which are incorporated herein by reference in their entirety.

TECHNICAL FIELD

The present utility model relates to a hand-held chargeable optoelectronic illuminating lamp.

BACKGROUND OF THE ART

Lamps are applied to various fields of daily life and industrial manufacture. These lamps which range from the simplest electric torch to the searchlight for industrial application provide human beings with weapons of conquering the darkness. However, the conventional hand-held lamps such as the electric torch are generally of the type of using dry battery or rechargeable battery. In general, for charging the hand-held rechargeable illuminating lamps, a fixed charging plug is disposed at the rear end of the lamp, which would make the structure of the lamp become bulky. In addition, sometimes, it is difficult for the fixed plug to be inserted into a socket disposed within a relatively small space, and thereby it is difficult to accomplish the charging operation.

Contents of the Utility Model

In view of the above problems of the prior art, an object of the utility model is to provide a hand-held chargeable optoelectronic illuminating lamp, which has compact structure and is convenient for charging operation.

According to the utility model, a hand-held chargeable optoelectronic illuminating lamp comprises: a hollow lamp body; a battery frame accommodated within the hollow lamp body, a plurality of rechargeable battery are mounted thereon; a light emitting unit, which is provided at front ends of the lamp body and the battery frame, for emitting visible light; a power supply plug, which is movably provided at a rear end of the lamp body and can fit with a socket of commercial power supply outside; and a handle, which is pivotally connected to the lamp body, and has an accommodating space therein, said handle may be in a first position and a second position relative to the lamp body, the handle is parallel to the lamp body and the power supply plug is contained in the accommodating space when the handle locates on the first position; the handle is perpendicular to the lamp body and the power supply plug is exposed out of the rear end of the lamp so as to implement charging operation when the handle locates on the second position.

In the illuminating lamp mentioned above, the light emitting unit comprises a light seat, a light source, a reflective mirror generally in a paraboloid shape, a front plate member and a front annular cap in order, wherein: said light seat is movably mounted at the front end of the battery frame; said light source is mounted on the light seat; said reflective mirror is disposed at the periphery of the light source so as to converge the light emitted from the light source; inner face of the front plate member is sealed with end face of the reflective mirror; and the annular cap is detachably fixed to the front end of the lamp body so as to encapsulate the light emitting unit.

In the illuminating lamp mentioned above, a driving circuit device is fixedly mounted at the rear end of the battery frame, and is provided with a plurality of state indicating lights for displaying work states of the illuminating lamp.

In the illuminating lamp mentioned above, two pins and two guiding slots are provided at the rear end of the lamp body; the power supply plug is pivotally connected with said two pins via two holes formed on the sidewall of the power supply plug; two conductive pins of the power supply plug pass through said two guiding slots and protrude out of the lamp body so that the power supply plug can insert into the socket of the commercial power.

In the illuminating lamp mentioned above, the handle is of cuboid shape; a hole for rotation is formed on each side of the front end of the handle; a hole for rotation is formed at the corresponding position of the lamp body; the handle is movably connected to the lamp body by passing a rotation lock through the holes of the handle and the holes of the lamp body.

In the illuminating lamp mentioned above, the inner surface of the rotation lock is provided with protruding fasteners which tightly fastens the inner surface of the sidewall of the lamp body so that the handle is fastened on the sidewall of the lamp body without separating from the lamp body while the handle is pivotally connected with the lamp body by the rotation lock.

In the illuminating lamp mentioned above, a switch button is provided at the centre of the battery frame so as to turn on and turn off the lamp.

In the illuminating lamp mentioned above, the rotation lock is formed with a rectangular hole; the position of the rectangular hole corresponds to the position of the switch button; a switch button covering member is provided on the rectangular hole; the inner surface of the switch button covering member passes through the rectangular hole of the rotation lock and thereby tightly engage with the switch button.

In the illuminating lamp mentioned above, a plurality of state indicating lights is provided on the driving circuit device.

In the illuminating lamp mentioned above, a hole is also provided on the front end of the lamp body; and an indicating light glass made of transparent material is fixed on the hole so that states of said state indicating lights would be observed through the indicating light glass.

The advantageous effects of the utility model are as follows: the novel hand-held chargeable optoelectronic illuminating lamp of the utility model provides the user with a convenient charging manner for the lamp by rotating the handle into the second position such that the handle is perpendicular to the lamp body and the power supply plug is exposed out of the rear end of the lamp body. For implement of charging the lamp, the user can directly insert the power supply plug of the lamp body into the socket of the commercial power. After the charging operation of the hand-held chargeable optoelectronic illuminating lamp is completed, the lamp can continuously illuminate for a relatively long time and can be applied to various fields such as police, fire protection, emergency lifesaving, discipline army and civil use as an important light source.

Hereinafter, the utility model will be further explained with reference to the drawings and the embodiments.

PREFERRED EMBODIMENTS OF THE UTILITY MODEL

Figure 1:
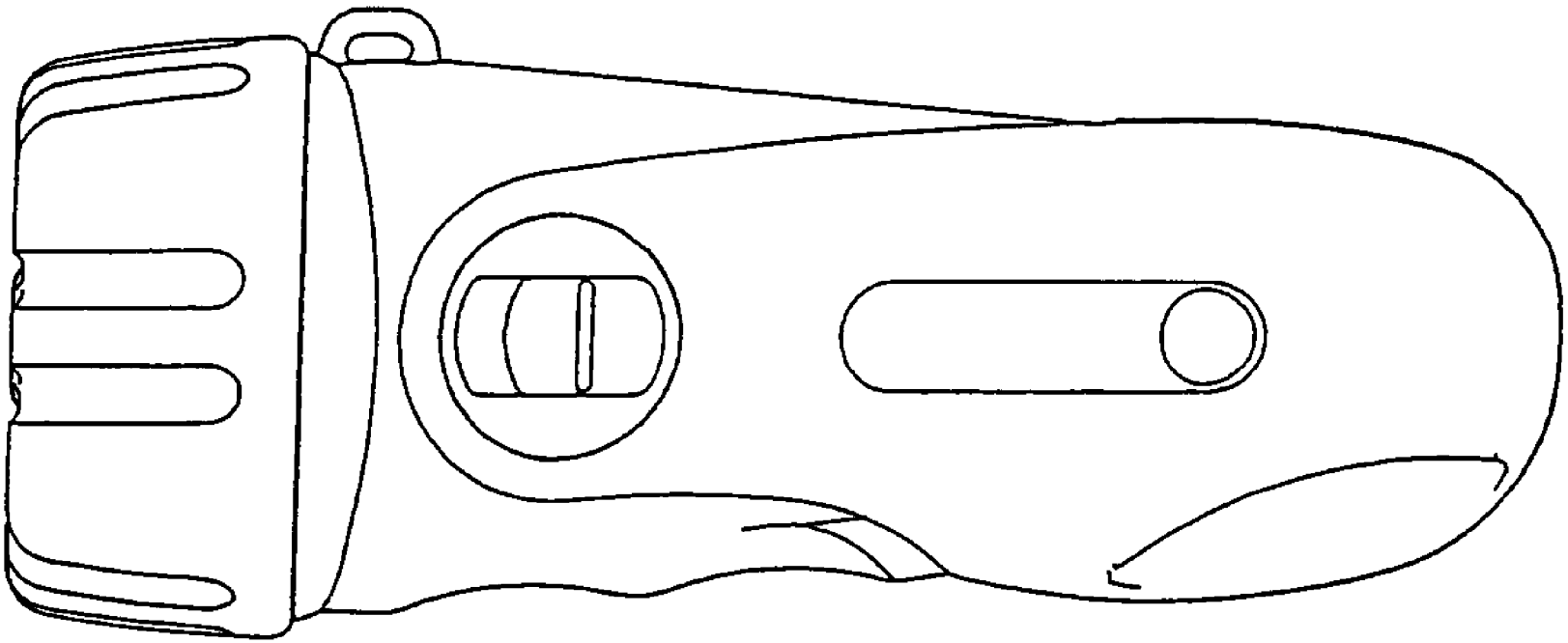
FIG. 1 is a side view of an illuminating lamp of the utility model.
Figure 2:
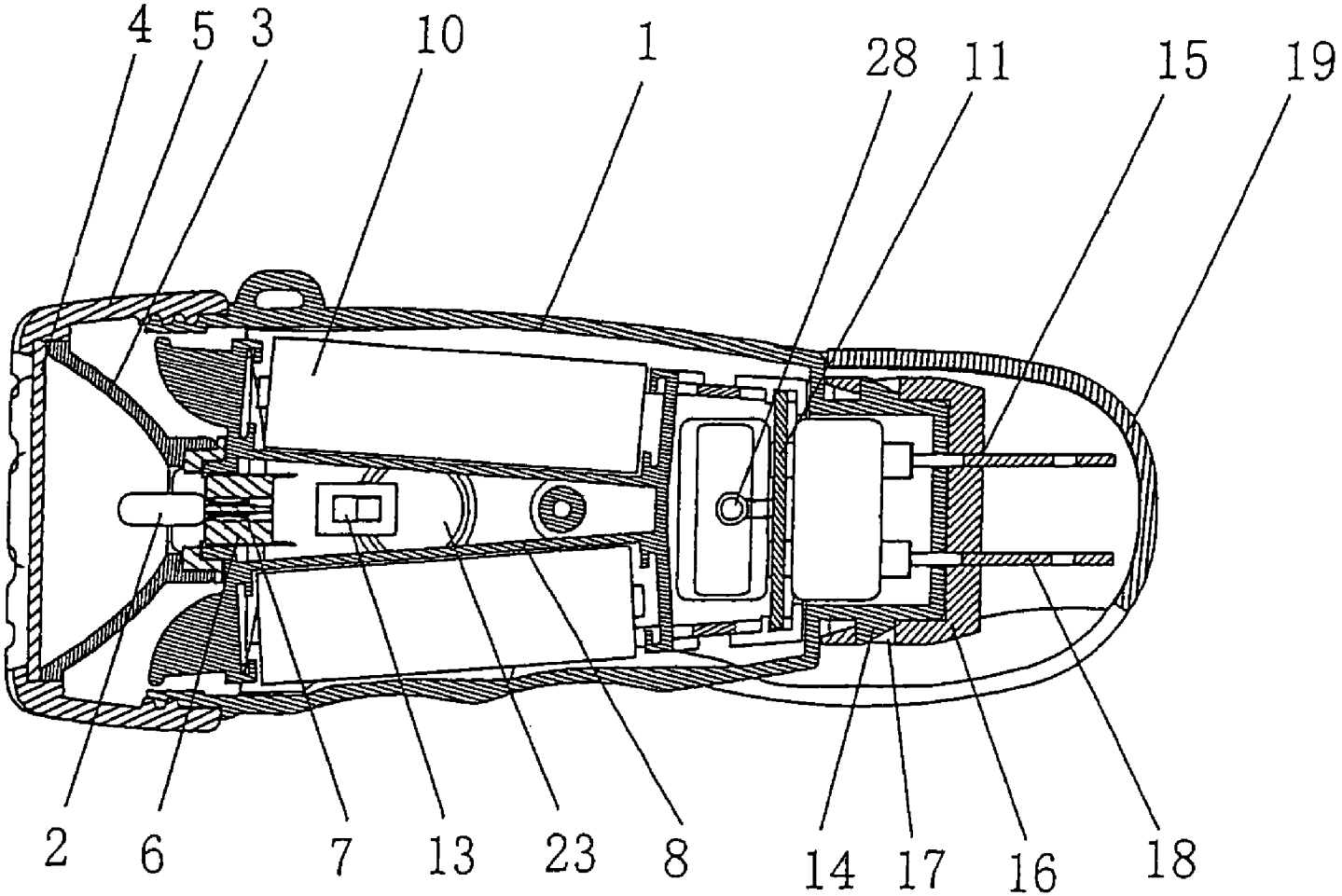
FIG. 2 is a vertical section view of the illuminating lamp shown in FIG. 1.
Figure 3:
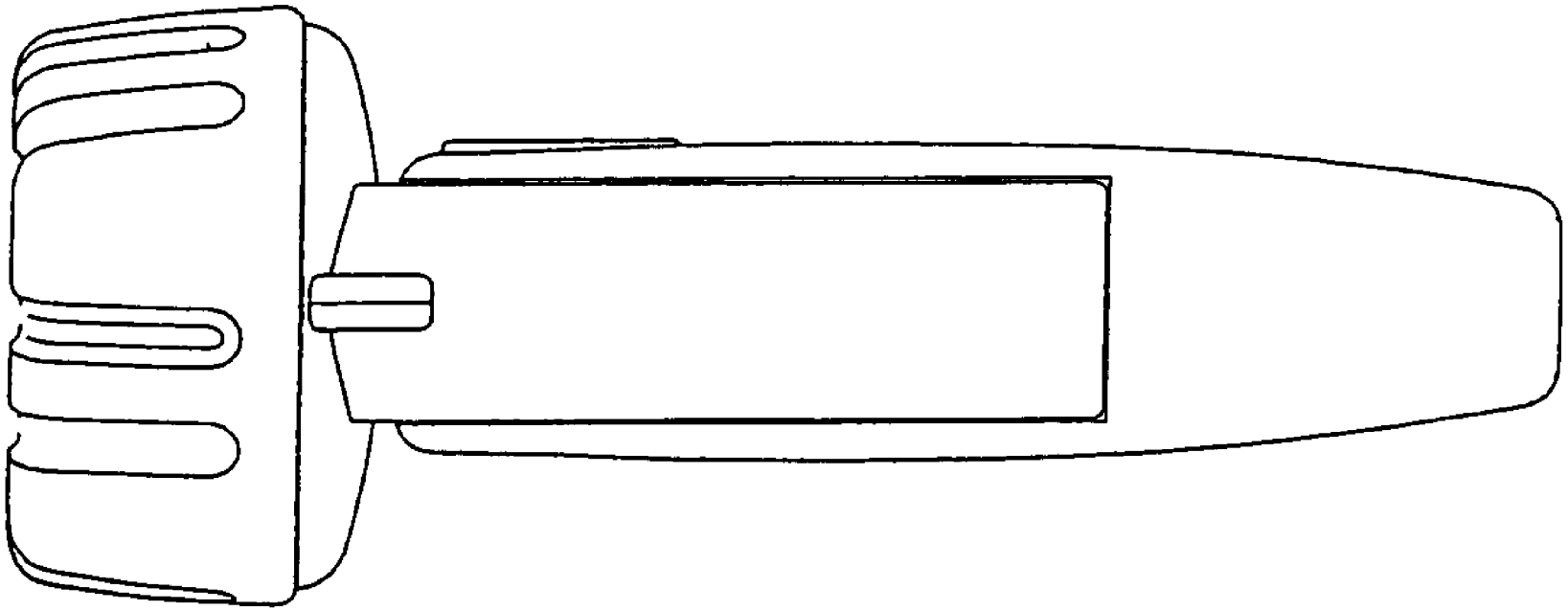
FIG. 3 is a top view of the illuminating lamp shown in FIG. 1.
Figure 4:
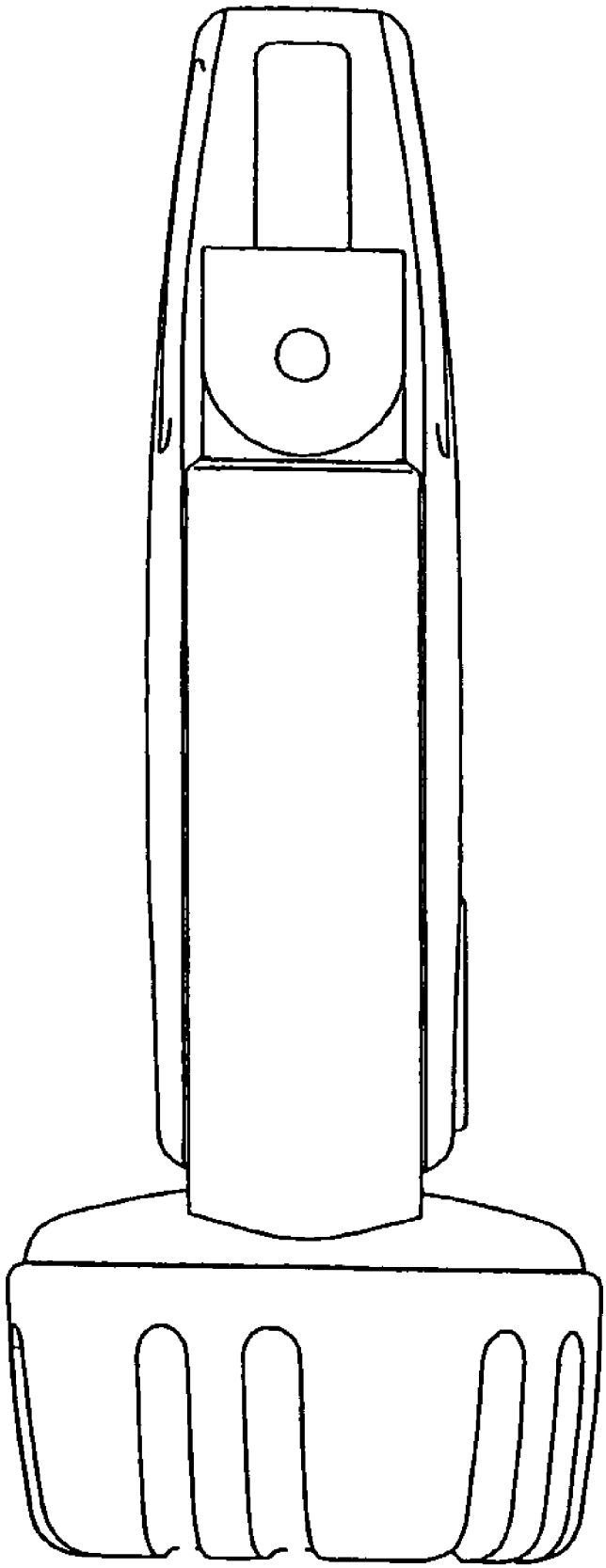
FIG. 4 is a bottom view of the illuminating lamp shown in FIG. 1.
Figure 5:
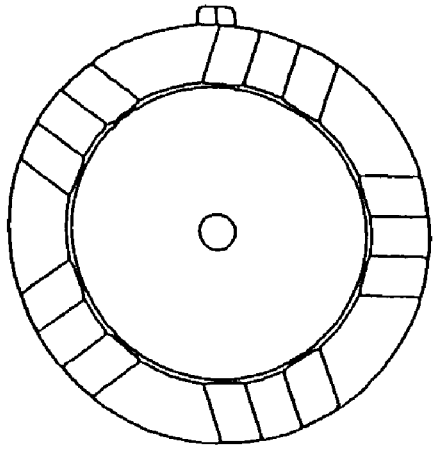
FIG. 5 is a front view of the illuminating lamp shown in FIG. 1.
Figure 6:
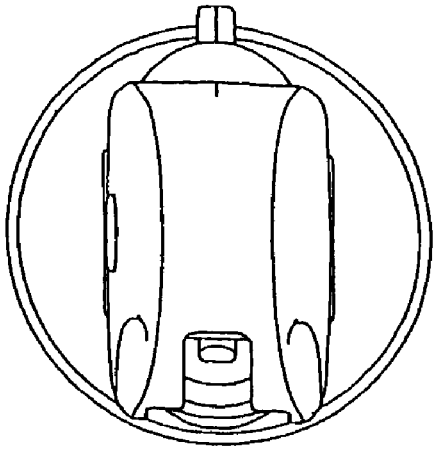
FIG. 6 is a back view of the illuminating lamp shown in FIG. 1.
Figure 7:
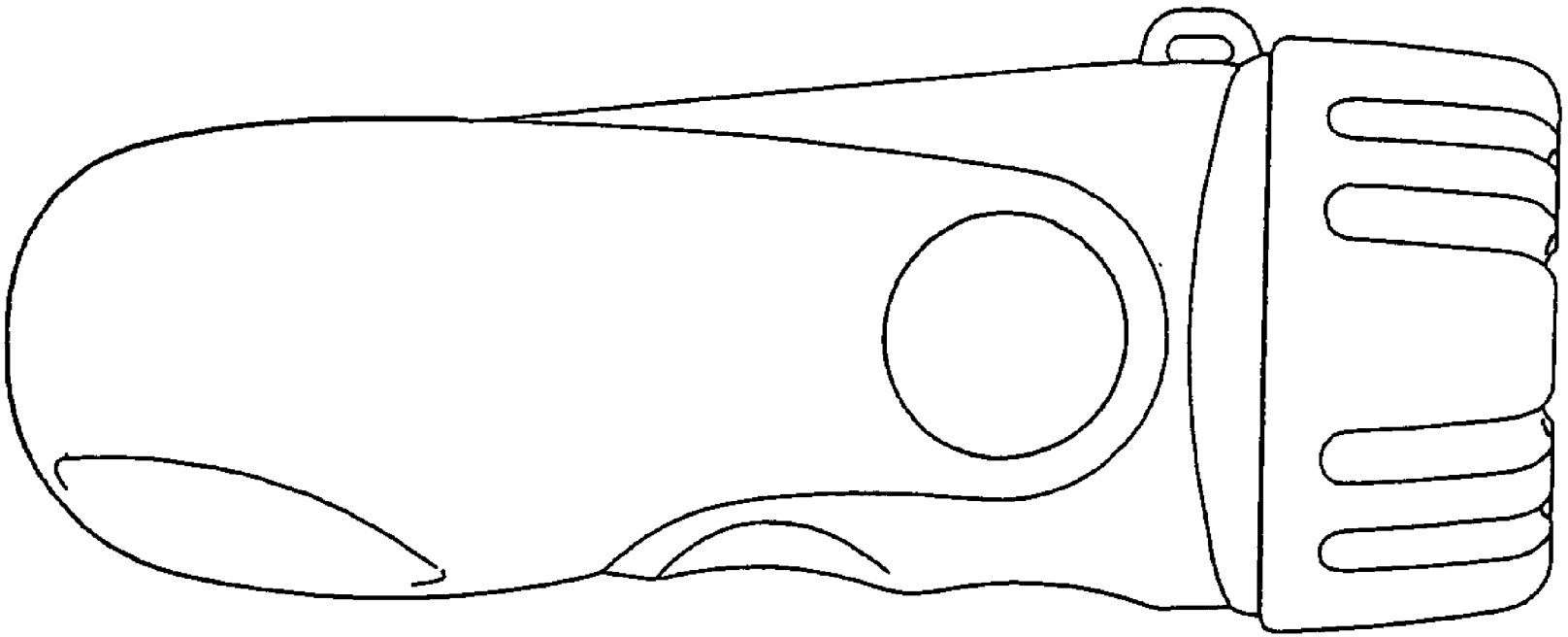
FIG. 7 is another side view of the illuminating lamp of the utility model.
Figure 8:
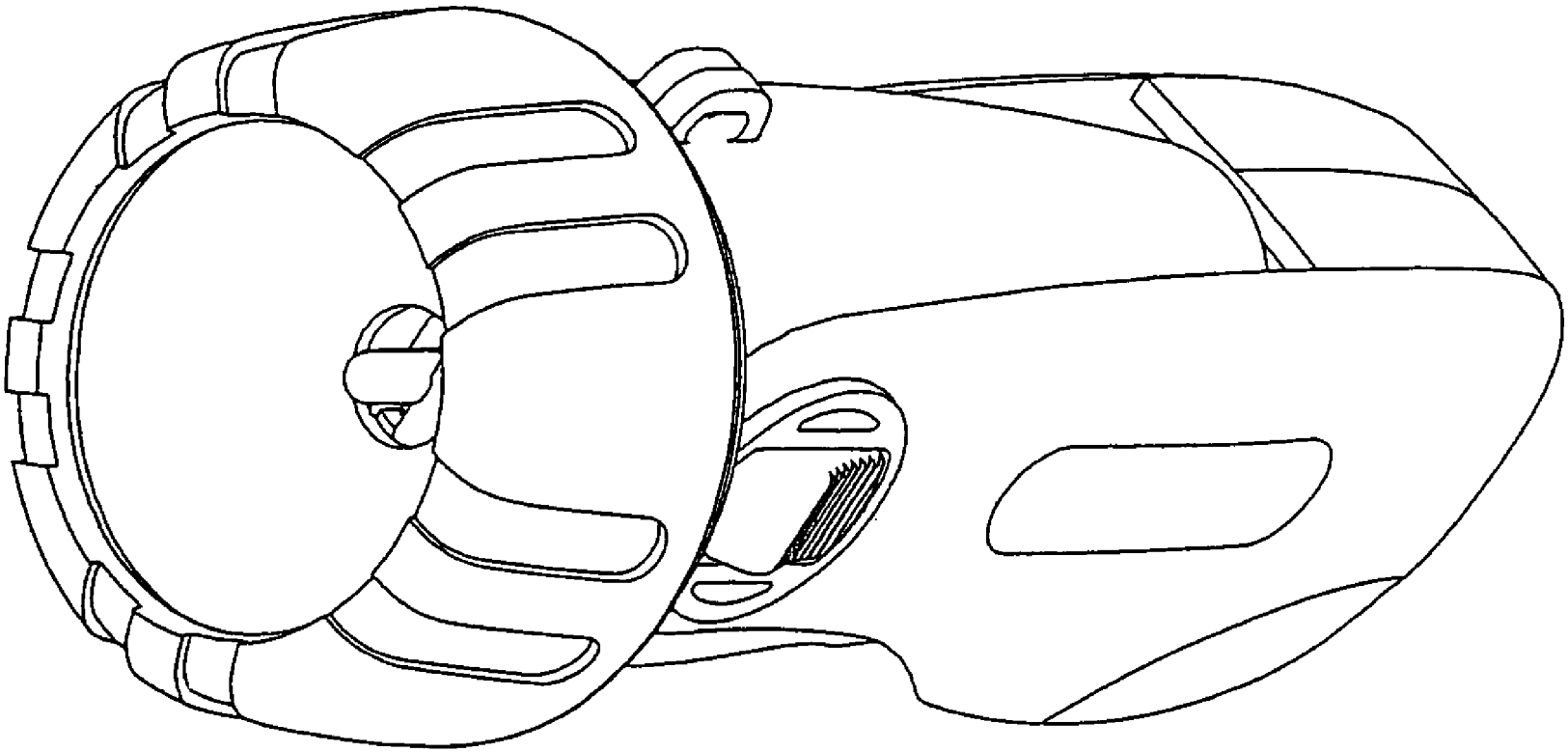
FIG. 8 is a front perspective view of the illuminating lamp, in which the handle is located in a first position relative to a lamp body.
Figure 9:
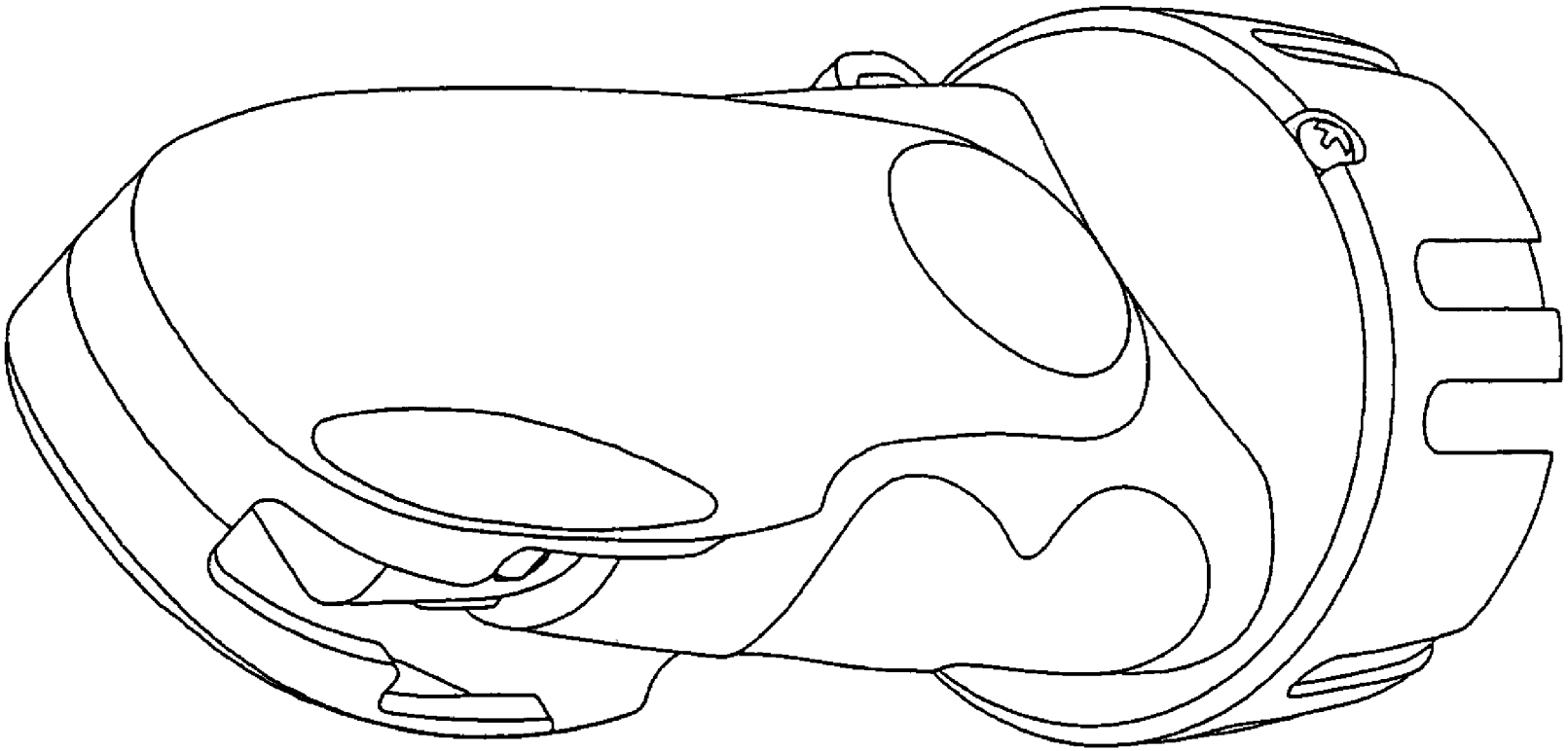
FIG. 9 is a rear perspective view of the illuminating lamp, in which the handle is located in the first position relative to the lamp body.
Figure 10:
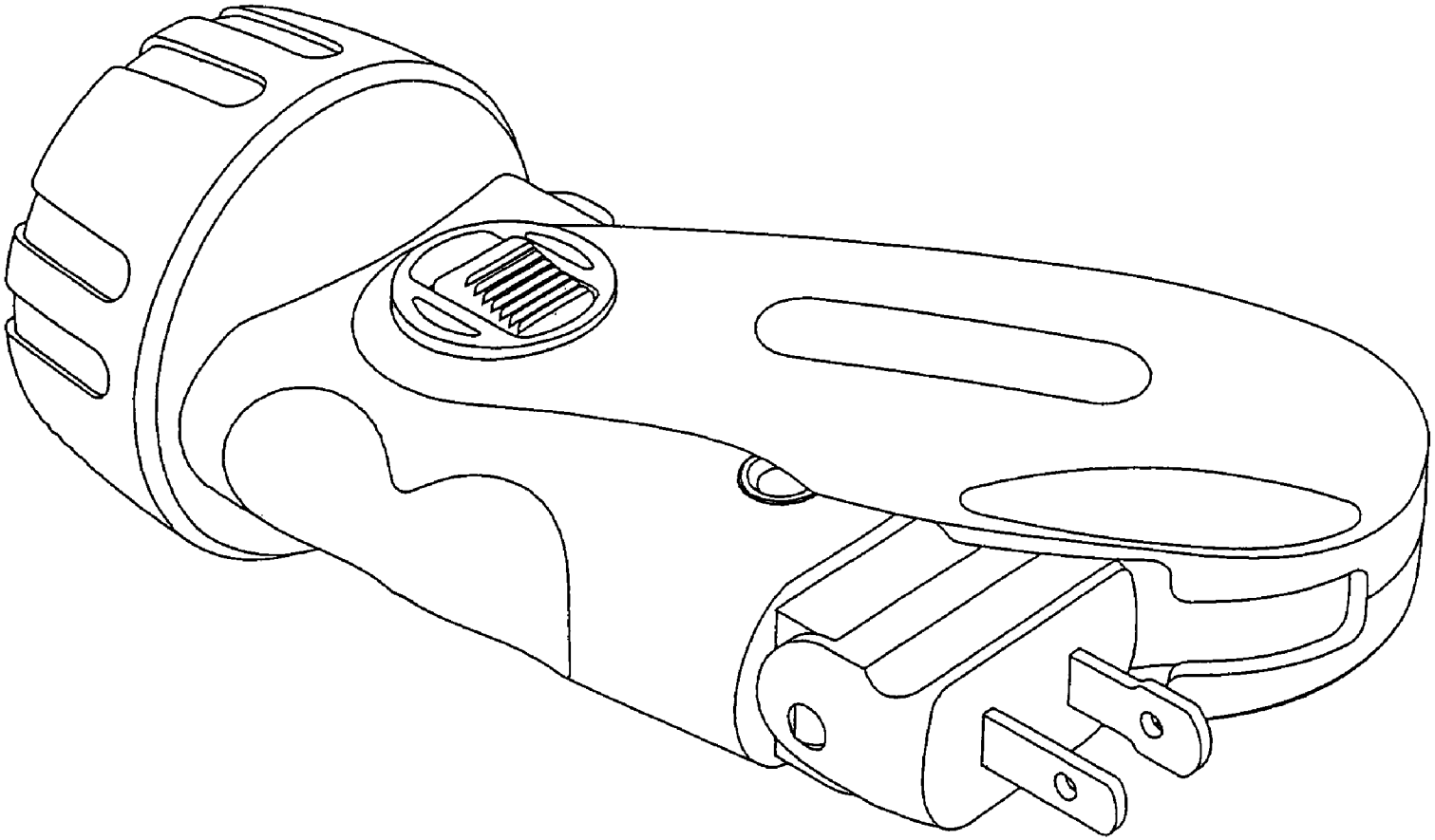
FIG. 10 is another perspective view of the illuminating lamp, in which the handle is located in a second position relative to the lamp body.
Figure 11:
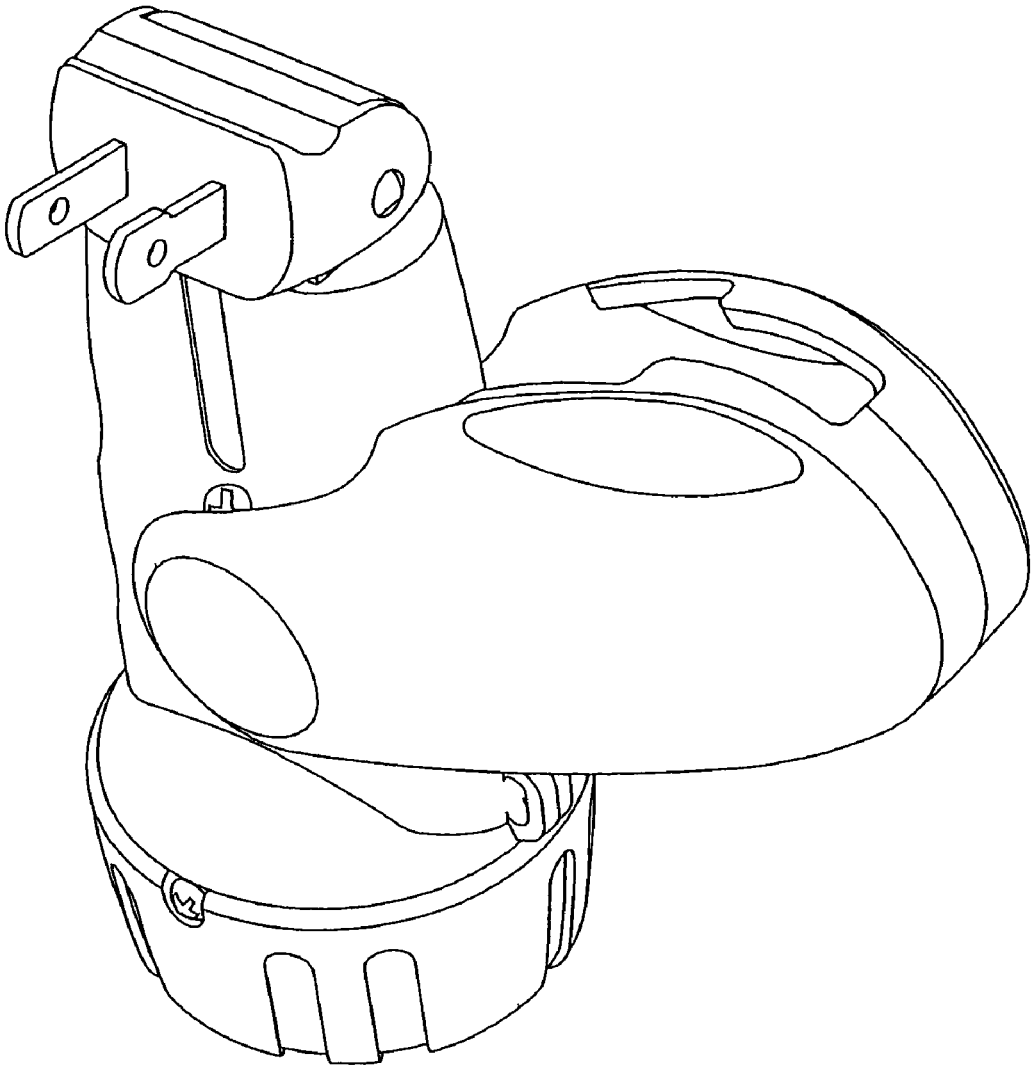
FIG. 11 is a further perspective view of the illuminating lamp, in which the handle is located in the second position relative to the lamp body while the power supply plug is adjusted by a certain angle.
Figure 12:
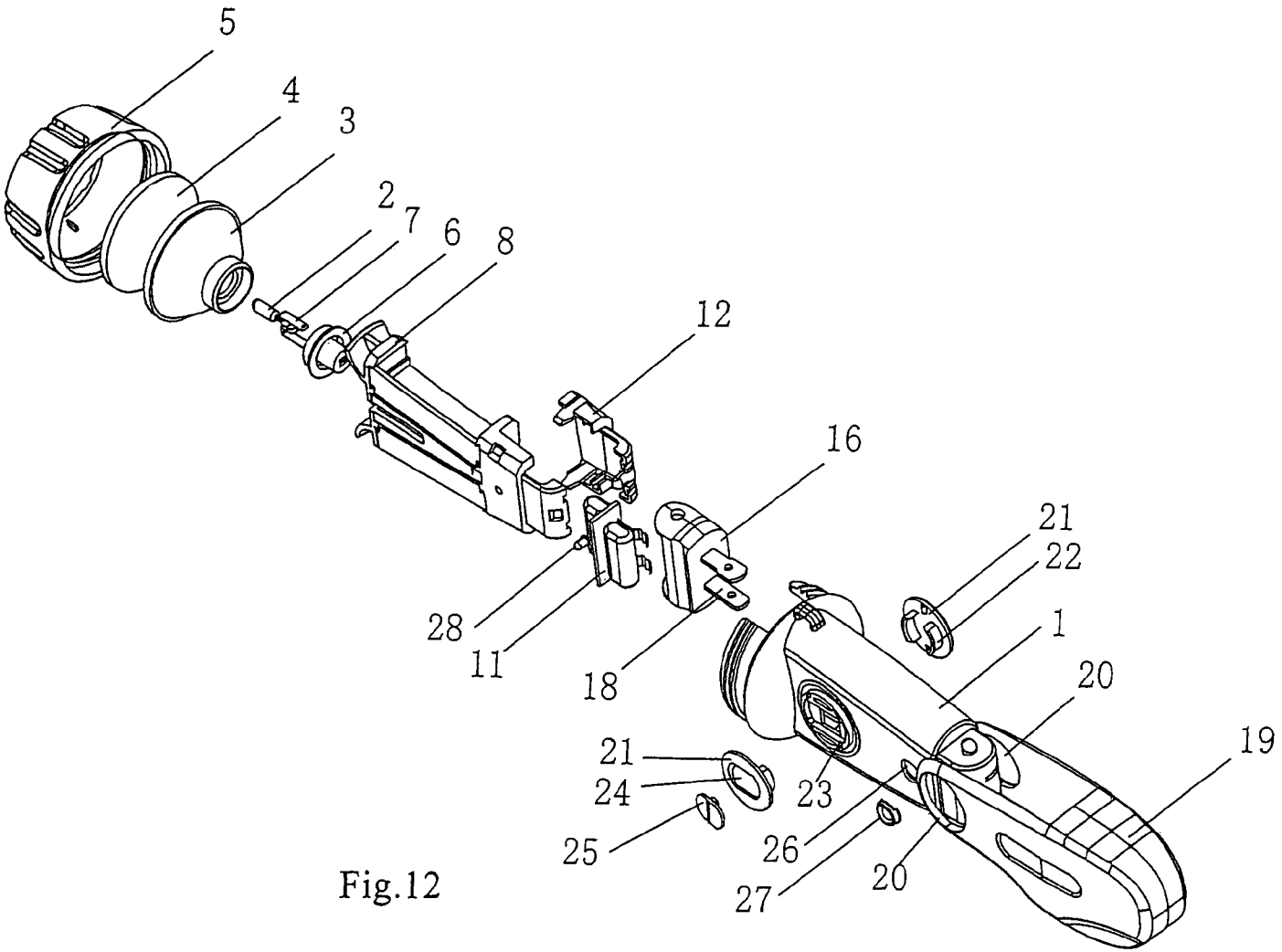
FIG. 12 is an exploded perspective view of the lamp.

FIG. 2 and FIG. 12 show a vertical section view and an exploded perspective view of a hand-held chargeable optoelectronic illuminating lamp of the utility model, respectively. The hand-held chargeable optoelectronic illuminating lamp of the utility model comprises: a hollow lamp body 1, which is generally of cuboid shape; a battery frame 8, which is accommodated within the hollow lamp body 1, for supporting a plurality of rechargeable battery 10 thereon; a light emitting unit, which is provided at front ends of the lamp body 1 and the battery frame 8, for emitting visible light; a power supply plug 16, which is movably provided at a rear end of the lamp body 1, for connecting a socket of commercial power supply outside so as to charge the plurality of rechargeable battery; and a handle 19, which is pivotally connected to the lamp body 1, and has an inner accommodating space within which the power supply plug 16 is contained while the handle 19 is rotated to a first position parallel to the lamp body 1, so as to make the appearance of the illuminating lamp better as shown in FIG. 8 and FIG. 9. On the other hand, the power supply plug 16 will be exposed so as to implement the charging operation when the handle 19 is rotated to a second position perpendicular to the lamp body 1, as shown in FIG. 10 and FIG. 11.

More specifically, the light emitting unit comprises a light seat 6, a light source 2, a reflective mirror 3 generally in a paraboloid shape, a front plate member 4 made of glass or other transparent material, and a front annular cap 5 in order. The light seat 6 is movably mounted at the center of the circular flange at the front end of the battery frame 8. The light source 2 is a bulb which is an energy-saving light source and is movably mounted on the center of the light seat 6. The light seat 6 is provided with a contact plate 7 made of conductive metal. The contact plate 7 is electrically connected to the rechargeable battery 10 on the battery frame 8 and also connected to the electric contact pad at the bottom end of the bulb so that the bulb can obtain the power from the battery and thereby emit light. The inside face of the front plate member 4 is sealed with the end face of the reflective mirror 3. The annular cap 5 is detachably fixed to the front end of the lamp body 1 by means of e.g. screw connection, for encapsulating the light emitting unit.

As shown in FIG. 12, the battery frame 8 can hold two pieces of rechargeable batteries 10. A driving circuit device 11 is also fixed at the rear end of the battery frame 8, and a plurality of state indicating lights 28 for displaying work states of the illuminating lamp are provided on the driving circuit device 11. The battery frame 8 is also provided with a pin covering member 12 for sealing and protecting the driving circuit device 11. In addition, in order to conveniently operate the illuminating lamp, a switch button 13 is also provided at the center of the battery frame 8, for turning on and turning off the illuminating lamp.

In order to connect the power supply plug 16 movably to the rear end of the lamp body 1, two pins 14 and two guiding slots 15 are provided at the rear end of the lamp body 1 in one embodiment of the utility model. The power supply plug 16 is pivotally connected with two pins 14 via two holes 17 formed on the sides thereof. Two conductive pins 18 of the power supply plug 16 pass through two guiding slots 15 and protrude out of the lamp body 1 so that the plug 16 can be inserted into the socket of the commercial power supply. With the structure that the power supply plug 16 is pivotally connected to the lamp body 1, the power supply plug 16 can be rotated in any direction. Thereby, even when the socket to be fitted with the power supply plug 16 is disposed within a relatively small space, it is convenient for the power supply plug 16 to insert into the socket by rotating of the power supply plug 16.

The electric power enters into the lamp body 1 through the power supply plug 16 connecting with the outside commercial power supply, and then enters into the driving circuit device 11 in the lamp body 1 through power cords so as to charge the rechargeable battery 10 in the lamp body 1. The rechargeable battery 10 is connected to the optoelectronic light source 2 via the switch button 13 so as to provide power to the light source 2.

The handle 19 is generally of cuboid shape so that it is easy to hold it. A hole 20 for rotation is provided on each side of the front end of the handle 19. Correspondingly, a hole 23 for rotation is provided at the corresponding position of the lamp body 1. The handle 19 is movably connected to the lamp body 1 by passing a rotation lock 21 through the holes 20 of the handle 19 and the holes 23 of the lamp body 1. The inner surface of the rotation lock 21 is provided with protruding fasteners 22 which tightly fastens the inner surface of the side wall of the lamp body 1 so as to make the handle 19 rotate only around the lamp body 1, and prevent the handle 19 from separating from the lamp body 1. With above structure, the handle 19 and the lamp body 1 are movably connected with each other by the rotation lock 21, and the handle 19 may locate at any position between the first position and the second position. While in the first position, the handle 19 and the lamp body 1 are in line so as to provide an appropriate handle for a user to hold; while in the second position, the handle 19 is perpendicular to the lamp body 1 so that the power supply plug 16 may expose out of the rear end of the lamp body 1 and thereby the lamp can be charged. In addition, as mentioned above, the angle of the power supply plug 16 can be adjusted so that it is convenient for the user to adjust the angle of the hand-held chargeable optoelectronic illuminating lamp while inserting the power supply plug 16 into the socket of the commercial power.

The rotation lock 21 is formed with a rectangular hole 24. The position of the rectangular hole 24 corresponds to the position of the switch button 13 of the battery frame. After the illuminating lamp is assembled, the switch button 13 is just below the rectangular hole 24. A switch button covering member 25 is provided above the rectangular hole 24. The inner surface of the switch button-covering member 25 can pass the rectangular hole 24 of the rotation lock 21 and thereby tightly engage with the switch button 13. In other words, the user can press the switch button 13 by pressing the switch button covering member 25 so as to control the turnon and turnoff of the illuminating lamp.

Additionally, a hole 26 is also provided on the front end of the lamp body 1; and an indicating light glass 27 made of transparent material is fixed on the hole 26 so that the user can see the state indicating light 28 on the driving circuit device 11 from the indicating light glass 27 and thereby confirm the usage state of the hand-held chargeable optoelectronic illuminating lamp, for example, whether or not the charging operation is still going on, whether or not the charging operation is completed, and so on.

In conclusion, the novel hand-held chargeable optoelectronic illuminating lamp of the utility model provides the user such a convenient charging manner of rotating the handle 19 into the second position where the handle 19 is perpendicular to the lamp body 1, and thereby making the power supply plug 16 expose out of the rear end of the lamp body 1. For implement of charging the lamp, the use can directly insert the power supply plug 16 of the lamp body 1 into the socket of the commercial power. After the charging operation of the hand-held chargeable optoelectronic illuminating lamp is completed, it can continuously illuminate for a relatively long time and can be applied to various fields such as police, fire protection, emergency lifesaving, discipline army and civil use as an important light source.

What is claimed is:

1. A hand-held chargeable optoelectronic illuminating lamp comprising:

a hollow lamp body;

a battery frame which is accommodated within the hollow lamp body and a plurality of rechargeable batteries mounted thereon;

a light emitting unit which is provided at front ends of the lamp body and the battery frame, for emitting visible light;

a power supply plug which is pivotally provided at a rear end of the lamp body, for fitting with a outside socket of commercial power; and a handle which is pivotally connected to the lamp body, has an accommodating space therein, and the handle may locate in a first position and a second position relative to the lamp body, wherein the handle is parallel to the lamp body and the power supply plug is contained in the accommodating space when the handle locates in the first position; the handle is perpendicular to the lamp body and the power supply plug is exposed out of the rear end of the lamp so as to implement chargeable operation when the handle locates in the second position.

2. The illuminating lamp according to claim 1, wherein the light emitting unit comprises a light seat, a light source, a reflective mirror generally in a paraboloid shape, a front plate member and a front annular cap in order, wherein said light seat is movably mounted at the front end of the battery frame; said light source is mounted on the light seat; said reflective mirror is disposed at the periphery of the light source so as to converge the light emitted from the light source; inner face of the front plate member is sealed with an end face of the reflective mirror; and the annular cap is detachably fixed to a front end of the lamp body so as to encapsulate the light emitting unit.

3. The illuminating lamp according to claim 1, wherein a driving circuit device is fixedly mounted at the rear end of the battery frame, and is provided with a plurality of state indicating lights for displaying work states of the illuminating lamp.

4. The illuminating lamp according to claim 1, wherein two pins and two guiding slots are provided at the rear end of the lamp body; the power supply plug is pivotally connected with said two pins via two holes formed on the sidewall of the power supply plug; two conductive pins of the power supply plug pass through said two guiding slots and protrude out of the lamp body so that the power supply plug can insert into the socket of the commercial power.

5. The illuminating lamp according to claim 1, wherein the handle is of cuboid shape; a hole for rotation is formed on each side of the front end of the handle; a hole for rotation is formed at the corresponding position of the sidewall of the lamp body; the handle is movably connected to the lamp body by passing a rotation lock through the holes of the handle and the holes of the lamp body.

6. The illuminating lamp according to claim 5, wherein the inner surface of the rotation lock is provided with protruding fasteners which tightly fastens the inner surface of the sidewall of the lamp body so that the handle is fastened on the sidewall of the lamp body without separating from the lamp body while the handle is pivotally connected with the lamp body by the rotation lock.

7. The illuminating lamp according to claim 5, wherein a switch button is provided at the centre of the battery frame so as to turn on and turn off the lamp.

8. The illuminating lamp according to claim 7, wherein the rotation lock is formed with a rectangular hole; the position of the rectangular hole corresponds to the position of the switch button; a switch button covering member is provided on the rectangular hole; the inner surface of the switch button covering member passes through the rectangular hole of the rotation lock and thereby tightly engage with the switch button.

9. The illuminating lamp according to claim 3, wherein a plurality of state indicating lights are provided on the driving circuit device.

10. The illuminating lamp according to claim 9, wherein a hole is also provided on the front end of the lamp body; and an indicating light glass made of transparent material is fixed on the hole so that states of said state indicating lights would be observed through the indicating light glass.

11. The illuminating lamp according to claim 6, wherein a switch button is provided at the centre of the battery frame so as to turn on and turn off the lamp.

* * * * *